US007686746B2

(12) United States Patent
Koyama

(10) Patent No.: US 7,686,746 B2
(45) Date of Patent: Mar. 30, 2010

(54) TRAINING APPARATUS

(75) Inventor: Yasushi Koyama, Tottori (JP)

(73) Assignee: World Wing Enterprise Corporation, Tottori-shi (JP)

( * ) Notice: Subject to any disclaimer, the term of this patent is extended or adjusted under 35 U.S.C. 154(b) by 21 days.

(21) Appl. No.: 11/802,083

(22) Filed: May 18, 2007

(65) Prior Publication Data

US 2007/0287607 A1 Dec. 13, 2007

Related U.S. Application Data

(63) Continuation-in-part of application No. PCT/JP2005/002917, filed on Feb. 23, 2005.

(30) Foreign Application Priority Data

Dec. 28, 2004 (JP) ..... P2004-381653
Feb. 14, 2005 (JP) ..... P2005-036340

(51) Int. Cl.
*A63B 20/062* (2006.01)

(52) U.S. Cl. ..... 482/100; 482/92

(58) Field of Classification Search ..... 482/92–100, 482/142, 148, 139
See application file for complete search history.

(56) References Cited

U.S. PATENT DOCUMENTS

2004/0157711 A1* 8/2004 Regev ..... 482/142
2006/0160676 A1* 7/2006 Sato ..... 482/94
2007/0213184 A1* 9/2007 Habing et al. ..... 482/97
2007/0232462 A1* 10/2007 Webber et al. ..... 482/93

FOREIGN PATENT DOCUMENTS

JP 10-113405 5/1998
JP 10-137360 5/1998
JP 2004-135800 5/2004

* cited by examiner

*Primary Examiner*—Lori Baker
(74) *Attorney, Agent, or Firm*—Kratz, Quintos & Hanson, LLP

(57) ABSTRACT

A training apparatus 1 includes a seat part 2, a load application part 3 having an adjustable load, right and left guide poles 4 extending vertically with a predetermined interval so that the seat part 2 centered between the guide poles, two lifting parts 5 movable up and down and respectively guided by the right and left guide poles 4, rotating parts 7 connected to shafts 6 fixed to the lifting parts 5, respectively, and are rotatable with respect to the lifting parts 5, pulling members 8 having one-side ends connected to the load application part 3 and having other ends connected to the lifting parts 5, and load transmission parts 9 connected to the other ends of the pulling members 8 in the lifting parts 5, respectively, and apply load to rotation of the rotating parts 5 about the shafts 6 by the load application part 3.

12 Claims, 12 Drawing Sheets

1 TRAINING APPARATUS
2 SEAT PART
3 LOAD APPLICATION PART
4 GUIDE POLE
5 LIFTING PART
6 SHAFT
7 ROTATING PART
8 PULLING MEMBER
9 LOAD TRANSMISSION PART

1 TRAINING APPARATUS
2 SEAT PART
3 LOAD APPLICATION PART
4 GUIDE POLE
5 LIFTING PART
6 SHAFT
7 ROTATING PART
8 PULLING MEMBER
9 LOAD TRANSMISSION PART

100 TRAINING APPARATUS

10 SEAT PART
20 FRAME
30 LOAD APPLICATION PART
31 WEIGHT
40 GUIDE POLE
50 LIFTING/OSCILLATING PART
70 GRIP ROTATING PART
80 PULLING MEMBER

60 SHAFT

90 LOAD TRANSMISSION PART

200 TRAINING APPARATUS

10 SEAT PART
120 FRAME
130 LOAD APPLICATION PART
31 WEIGHT
140 GUIDE POLE
150 LIFTING PART
170 HAND-PUSHING ROTATING PART
180 PULLING MEMBER

160 SHAFT

90 LOAD TRANSMISSION PART

160 SHAFT

TRAINING APPARATUS

This application is a Continuation-in-Part Application of PCT/JP2005/002917, filed Feb. 23, 2005, the contents of which are incorporated herein by reference.

TECHNICAL FIELD

The present invention relates to a training apparatus to be used when muscles of shoulder parts, arm parts and a rear part are trained.

BACKGROUND ART

Training apparatuses which are used for training muscles of shoulder parts and a rear part include pull-down training apparatuses. With such a training apparatus, a user who sits on a seat grips one grip bar with both hands stretched upward, and pulls down the grip bar to pull up weights connected to the grip bar. As a result, a load is applied to the muscles of the shoulder parts and the rear part, so that the muscles are trained.

Training apparatuses which are used for training muscles of shoulder parts and arm parts and a rear part are trained include dipping machines. With such a training apparatus, a user who sits on a seat pulls up shoulders and bends elbows to grip the grip bars positioned in a vicinity of both sides of the user's body with both hands, respectively, and pushes down the grip bars to pull up weights connected to the grip bars. As a result, a load is applied to the muscles of the shoulder parts, the arm parts and the rear part so that the muscles are trained.

In the above training, a load of the weight of the weights is applied to the movement for pushing down the grip bars till the last. Such training is called ending movement load training, and the load is applied till the last and strong muscle strength is displayed at each joint angle, thereby strengthening the muscles with the strong tension (hardening) of the muscles (see Patent Document 1 and Non-patent Document 1).

Patent Document 1: Japanese Patent Application Laid-Open No. 2004-187724

Non-Patent Document 1: "New Training Revolution, New Version" written by Yasushi Koyama, Kodansha Ltd., Sep. 12, 1994, pp. 8 to 13

DISCLOSURE OF THE INVENTION

Problems to be Solved by the Invention

However, since muscles obtained by the ending movement load training are less soft and less elastic, there is a problem that body movements necessary for actual competitive sports are lost. Further, since the muscle strength is output from parts where less muscle strength may be output and training is made in an moving form and an output form different from the actual moving forms in the ending movement load training, there is a problem that users feel discomfort in the body movements. Since the supply of oxygen to muscular cells is disturbed by the tension of muscles and blood stream cannot be washed out, there is a problem that fatigue substance such as produced lactic acid are stored, and burdens such as muscle ache and fatigue on bodies become large. The hardening of the muscles is the big cause of injury.

The present invention is devised in view of the above problems, and its object is to provide a training apparatus which is capable of obtaining soft and elastic muscles of shoulder parts, arm parts and a rear part with the hardening of the muscles being caused and loads such as muscle pain and fatigue on a body being less.

Means for Solving Problems

In order to achieve the above object, a training apparatus according to a first aspect includes: a seat part; a load application part the magnitude of a load can be adjusted; right and left guide poles extending vertically with a predetermined interval so that the seat part is in their center position; two lifting parts guided by the right and left guide poles to be movable up and down, respectively; rotating parts connected to shafts fixed to the two lifting parts, respectively, to be rotatably provided to the lifting parts; pulling members whose one-side ends are connected to the load application part and whose other ends are connected to the lifting parts; and load transmission parts connected to the other ends of the pulling members in the lifting parts to apply the loads to rotations of the rotating parts about the shafts by means of the load application part.

The training apparatus of a second aspect according to the first aspect is characterized in that the two lifting parts are guided by fitting the right and left guide poles in to one-side ends of the two lifting parts to be movable up and down and rotatable horizontally, the shifts are fixed to the other ends of the two lifting parts, respectively, and the rotating parts connected to the shafts are rotatably provided below the lifting parts, and the other ends of the pulling members are connected to parts of the lifting parts closer to the other ends than the fitting positions of the guide poles.

The training apparatus of a third aspect according to the first aspect is characterized in that the two lifting parts are guided by the right and left guide poles to be movable only up and down, respectively, and the rotating parts connected to the shafts are rotatably provided above the lifting parts.

The training apparatus of a fourth aspect according to any one of the first to third aspects is characterized in that the seat part, the load application part and the right and left guide poles are fixed to predetermined positions in one frame.

The training apparatus of a fifth aspect according to the fourth aspect is characterized in that the load application part is composed of weights supported to the frame movable up and down and connectable/detachable to/from one another.

The training apparatus of a sixth aspect according to any one of the first to fifth aspects is characterized in that the load transmission part includes: a rotation transmission part which transmits a rotation movement about the shaft of the rotating part; and a crank mechanism part which converts the rotational movement transmitted by the rotation transmission part into an up and down movement of a sliding shaft connected to the other end of the pulling member.

A training apparatus of a seventh aspect is characterized in that a load transmission part includes: a rotation transmission part which transmits a rotation movement about a shaft; and a crank mechanism part which converts the rotational movement transmitted by the rotation transmission part into an up and down movement of a sliding shaft connected to the other end of a pulling member whose one end is connected to the load.

EFFECTS OF THE INVENTION

According to the training apparatus from the first aspect, when a user sat on the seat part is retaining the rotating parts in the suitable vertical position with both hands and simultaneously rotates them, muscles of user's predetermined portions are "relaxed", and the rotating parts are biased up by the loads of the load application part via the pulling members. For this reason, the muscles of the user's predetermined portions are "stretched". While rotating the rotating parts to a direction opposite to the former rotating direction and further making the "relaxing" and "stretching" movement so that the suitably "stretched" muscles are reflected, the user "contracts" the muscles of the predetermined portions against the loads of the load application part. When the rotating parts are rotated to the direction opposite to the rotating direction with respect to the lifting parts, this movement is partially against the loads of the load application part, so that the loads in the first movement for moving the rotating parts and the lifting parts up and down are reduced. When the forces of the hands are released, the moved lifting parts are guided by the guide poles to be return to its original position by the function of the load application part, and thus the same movement is repeated. A series of the "relaxing-stretching-contracting" movements are promoted, and co-contraction is prevented. As a result, the functions of nerves and muscles and cooperativeness are heightened, and thus the soft and elastic muscles can be obtained with the burden on the body such as muscle pain and fatigue being reduced and the hardening of the muscles not being caused. Further, when aerobic metabolism is stimulated with less forcible rise in a heart rate and blood pressure, this training is effective for the protection against lifestyle-related diseases such as diabetes and high pressure and the cure promotion of ligament damage, fracture and the like, and states, which are useful for bodies, such as elimination of stresses on nerves, muscles and joints and elimination of waste products can be created.

According to the training apparatus from the second aspect, when the user sat on the seat holds the rotating parts with stretched-up hands and twist the upper arms outward, the user's shoulders and arms are "relaxed", and the grip parts are biased up by the loads of the load application part via the pulling members. For this reason, the muscles of muscles near shoulder girdle are suitably "stretched". While further making the "relaxing" and "stretching" movement to twist the upper arms outward so that the suitably stretched muscles near the shoulder girdle are "reflected", the user bends both arms against the loads of the load application part and "contracts" the muscles so as to pull the grip rotating parts down. When the user twists the upper arms outward to rotate the rotating parts, this movement is against part of the loads of the load application part so that the load on the first movement for pulling down both arms is reduced. When both the arms are bent to pull the grip rotating parts down, the "relaxing" and "stretching" movements are being made by further twisting the upper arms outward so that the suitable "contracting" timing is allowed to appear. Therefore, the respective muscle groups obtain the "relaxing-stretching-contracting" timing, so that the movements can be made in good cooperation. Since the other ends of the pulling members are connected to the parts of the lifting parts closer to the other ends than the fitting position of the guide poles, the lifting parts are rotationally biased by the loads of the load application part via the pulling members. The user widens both the arms so that the lifting parts gradually face outward against the rotational biasing force and simultaneously bends both the arms to pull the grip parts down. At this time, the rotational biasing force to be the resistant force with respect to the outward widening of both arms is reduced according to the pulling-down of the grip parts by means of the bending of both the arms. For this reason, when the user bends both the arms to pull the rotating parts down, the user outputs approximately constant muscle strength to widen both arms outward, so as to pull the rotating parts down and simultaneously be capable of smoothly and gradually widening both arms outward. Therefore, the co-contraction of the muscles can be prevented. Since the pushed-down lifting parts are guided by the guide poles according to the function of the load application part when the forces of the hands are released, the same movements as the aforementioned ones are repeated. As a result, a series of the "relaxing-stretching-contracting" movements are promoted, and co-contraction is prevented, thereby heightening the functions of nerves and muscles and cooperativeness and thus obtaining the soft and elastic muscles with the burden on the body such as muscle pain and fatigue being reduced and the hardening of the muscles not being caused.

According to the training apparatus of the third aspect, when the user sat on the seat part grips and pushes the rotating parts with the hands pushed up near the shoulder parts and simultaneously twists the wrist, since the shoulder parts, arm parts and rear part are "relaxed" and the hand-pushing rotating parts are biased to the up direction by the loads of the load application part, the muscles of the rear part such as latissimus dorsi are suitably "stretched". The user is making the "relaxing" and "stretching" movements in order to further twist the upper arms outward so that the suitably "stretched" muscles of the rear part are "reflected", and simultaneously stretches both arms against the loads of the load application part and "contracts" the muscles of the rear part to pull the grip rotating parts down. When the user twists the wrist inward to rotate the rotating parts, this movement is against some of the loads of the load applications parts, and the loads at the first movement for stretching both the arms are reduced. Since the pushed-down lifting parts are guided by the function of the load application part and simultaneously ascend when the forces of the hands are released, the same movements as the above ones are repeated. When both the arms are stretched to push the grip rotating parts down and the muscles of the rear part are contracted, the "relaxing" and "stretching" movements are being made by further twisting the upper arms outward so that the suitable "contracting" timing is allowed to appear. Therefore, the respective muscle groups obtain the "relaxing-stretching-contracting" timing, so that the movements can be made in good cooperation. Further, since the lifting parts are guided by the guide poles so as to be movable up and down, the user can smoothly stretch both the arms to push the rotating parts down, thereby preventing the co-contraction of the muscles. As a result, a series of the "relaxing-stretching-contracting" movements are promoted, and co-contraction is prevented, thereby heightening the functions of nerves and muscles and cooperativeness and thus obtaining the soft and elastic muscles with the burden on the body such as muscle pain and fatigue being reduced and the hardening of the muscles not being caused.

According to the training apparatus of the fourth aspect, since the seat part, the load application part and the right and left guide poles are fixed to the predetermined positions of one frame, respectively, the training apparatus, in which the seat part, the load application part and the right and left guide poles are arranged in a suitable positional relationship so that the training involving a series the ideal movements and forms can be conducted, can be produced as cohesive one product. The apparatus can be easily carried.

According to the training apparatus of the fifth aspect, since the load application part is composed of the weights supported the frame movably up and down and connectable/detachable to/from one another, the weight of the weights to be connected and pulled up is adjusted so that the magnitude of the load can be easily adjusted.

According to the training apparatus of the sixth aspect, since the rotation movements about the shafts of the rotating parts are transmitted as the up and down movements to the sliding shafts connected to the other ends of the pulling members via the rotation transmission parts and the crank mechanism parts, the load application part can apply the loads to the rotation about the shafts of the rotating part.

According to the training apparatus of the seventh aspect, since the rotation movements about the shafts are transmitted as the up and down movement to the sliding shafts connected to the other ends of the pulling members via the rotation transmission parts and the crank mechanism parts, the load application part can apply the loads to the rotation about the shafts.

BEST MODE FOR CARRYING OUT THE INVENTION

Figure 1:
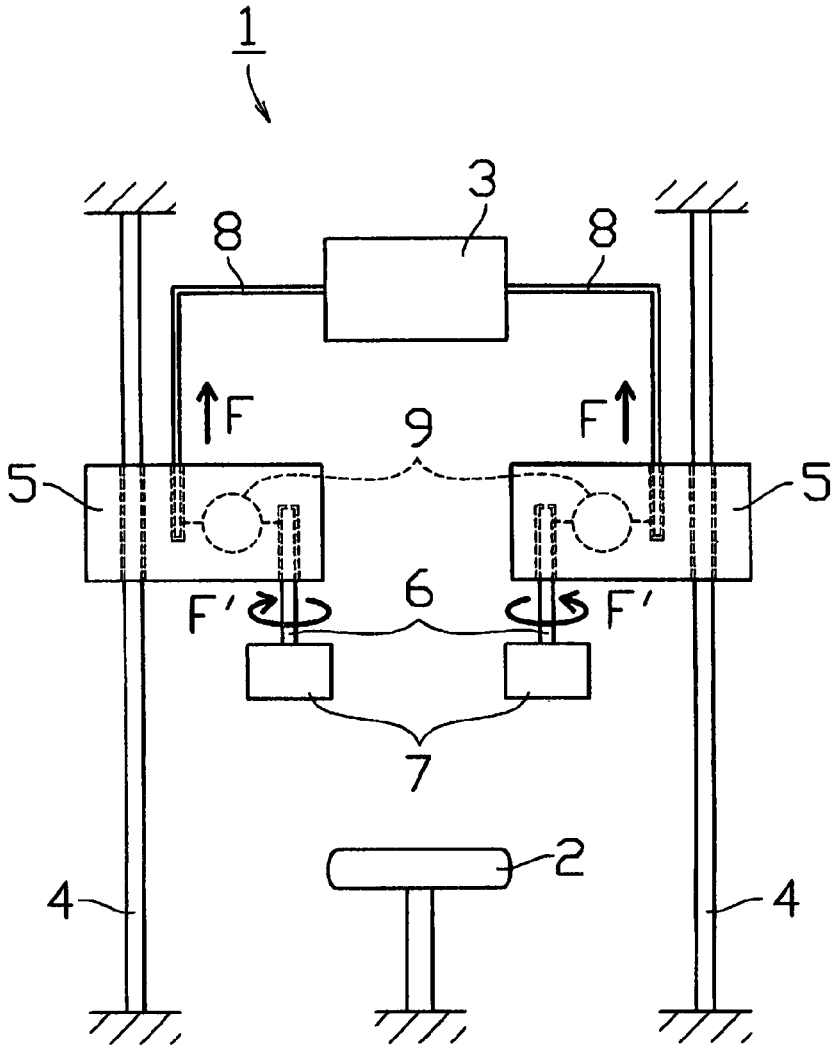
FIG. 1 is a conceptual explanatory diagram illustrating a training apparatus 1 according to the present invention.

As shown in a conceptual explanatory diagram of FIG. 1, a training apparatus 1 of the present invention includes: a seat part 2; a load application part 3 designed so that the magnitude of a load can be adjusted; right and left guide poles 4 extending vertically with a predetermined interval so that the seat part 2 is in their center position; two lifting parts 5 guided by the right and left guide poles 4 to be movable up and down, respectively; rotating parts 7 connected to shafts 6 fixed to the two lifting parts 5, respectively, to be rotatably provided to the lifting parts 5; pulling members 8 whose one-side ends are connected to the load application part 3 and whose other ends are connected to the lifting parts 5; and load transmission parts 9 connected to the other ends of the pulling members 8, in the lifting parts 5, to apply the loads to the rotation about the shafts 6 of the rotating parts 7 by the load application part 3.

A user, who trains himself/herself using the training apparatus 1, sits on the seat part 2, and holds the rotating parts 7 in a suitable vertical position with both hands to rotate the rotating parts 7 to a direction of a "dodge movement" position. At this time, vertical forces F which are applied to the lifting parts 5 by the load application part 3 via the pulling members 8 are transmitted and applied as resistant forces F' against the rotation of the rotating parts 7 via the load transmission parts 9, and the user should rotate the rotating parts 7 against the resistant forces F'. In the "dodge motion" position, flexor muscles and extensor muscles of certain portions are relaxed. At this time, since the load application part 3 applies the vertical forces F via the pulling members 8 to the rotating parts 7 which move vertically together with the lifting parts 5, the muscles of certain portions of the user who holds the rotating parts 7 are "stretched" by biasing forces due to the forces F.

The user rotates and twist the rotating parts 7 to a direction opposite to the former rotating direction so that the suitably "stretched" muscles are "reflected" moves the rotating parts 7 together with the lifting parts 5 to the vertical direction against the forces F so as to "contract" the muscles of the predetermined portions while making the "relaxing" and. "stretching" movements. When the rotating parts 7 are rotated to the direction opposite to the former rotating direction with respect to the lifting parts 5, the resistant forces in the beginning movement for moving the rotating parts 7 together with the lifting parts 5 to the vertical direction are reduced further than the forces F. When the rotating parts 7 are moved together with the lifting parts 5 to the vertical direction so that the muscles of the predetermined portions are "contracted", the further twisting movement is made, thereby obtaining the suitable "contraction" timing while the "relaxing" and "stretching" movements are made. As a result, the respective muscle groups obtain the timing of "relaxing-stretching-contracting" so as to be capable of making the movements in good cooperation.

After the user moves the rotating parts 7 to the predetermined vertical position, the user slowly returns himself/herself to a seated state according to the forces F. As a result, one cycle of the training is completed. A suitable cycle number of the training is repeated.

The training apparatus 1 can therefore train the muscles of the shoulder parts, the arm parts and the rear part by means of beginning movement load training (registered trademark). The beginning movement load training is defined as "training which is conducted while promoting a series of the relaxing-stretching-contracting steps for agonist muscle using a body change to a reflecting position and a change in a barycentric position due to the body change and preventing co-contraction of antagonistic muscles and muscular substances oppose the action of agonist muscle. This training is completely different from the ending movement load training which applies loads till the end to strengthen muscles in the tension (hardening) state of the muscles. It is necessary to conduct the beginning movement load training after whole movement images, such as a point at which a load is applied, a point and an angle and rhythm at which the load is released, and continuity of muscle output, are understood, and thus, it is difficult to make suitable movements and take suitable forms due to physical balance at this stage and partial hardening. However, this training apparatus 1 easily induces the training which involves a series of ideal movements and forms.

With the beginning movement load training using the training apparatus 1, "a force is transmitted between segments from a center part (essential part of body) to a terminal part" namely, in a state that muscular substances of a human body which do not stretch by themselves but contract are relaxed, a suitable load is applied to muscular spindles and a tendon organs as sensory receptors, the exertion of the force at the time of contracting the muscular substances is induced from a portion where the muscular substances suitably stretch or a part where muscular substances are stretched passively, at the instant of that time the load is progressively reduced with continuity. As a result, it is said that only a heart muscle do not co-contract, but an activity state such that the other muscular substances of a human body do not co-contraction can be obtained, thereby promoting and developing control of nerve muscles.

The beginning movement load training using the training apparatus 1 is training which causes reflection on muscles using the load of the training apparatus 1, makes the muscles which should originally function well operate and enhances the functions of muscles and nerves. The load is used as a catalyst for promoting the opportune stretching and contracting of relaxed muscles. When such training accelerates a series of the relaxing-stretching-contracting movements and prevents the co-contraction, the functions of nerves and muscles and cooperativeness are heightened, so that the soft and elastic muscles can be obtained with the burden on the body such as muscle pain and fatigue being reduced and the hardening of the muscles not being caused. Further, when aerobic metabolism is stimulated with less forcible rise in a heart rate and blood pressure, this training is effective for the protection against lifestyle-related diseases such as diabetes and high pressure and the cure promotion of ligament damage, fracture and the like, and states, which are useful for bodies, such as elimination of stresses on nerves, muscles and joints and elimination of waste products can be created.

Figure 2:
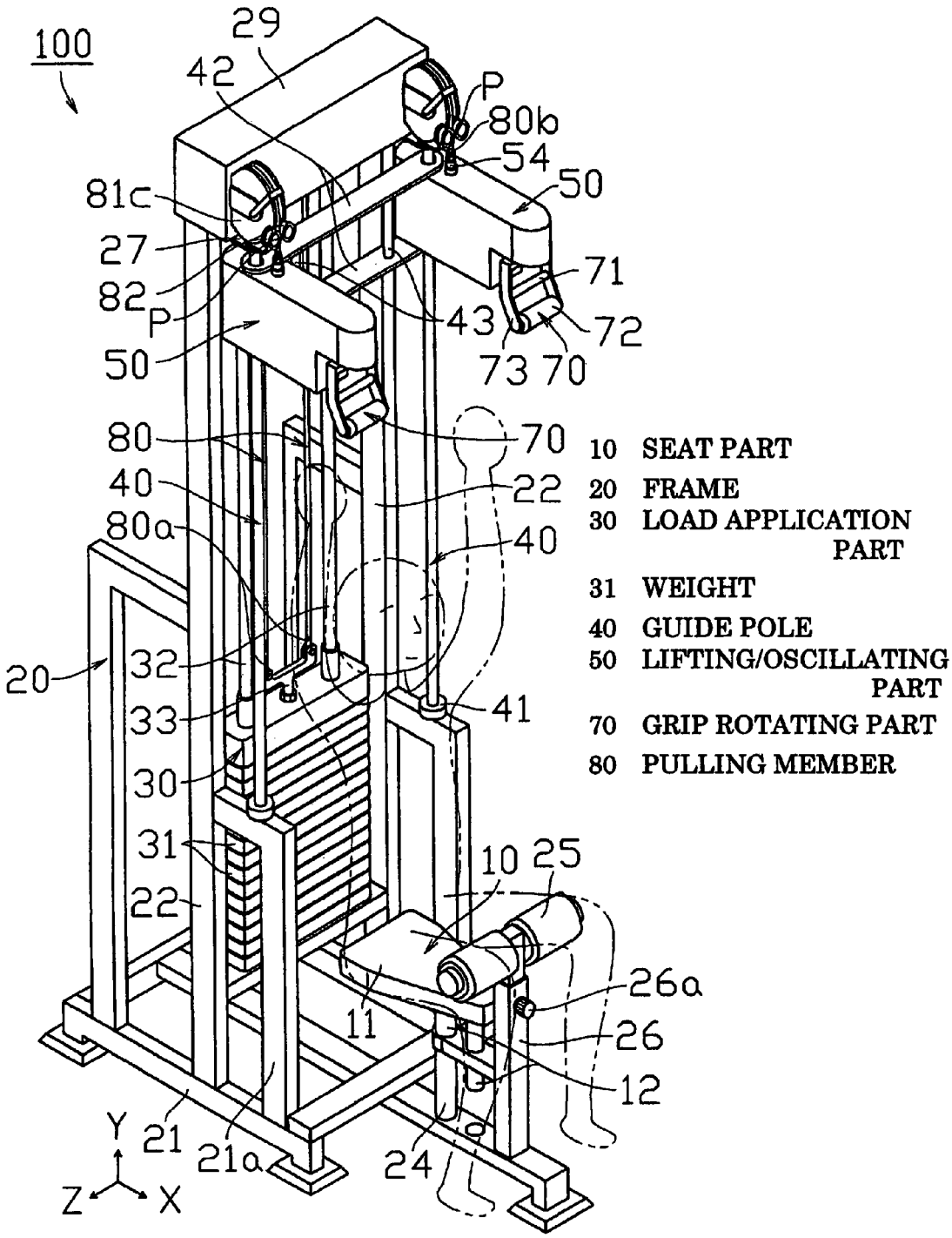
FIG. 2 is a perspective view illustrating a schematic appearance of a training apparatus 100 according to a first embodiment of the present invention.
Figure 3:
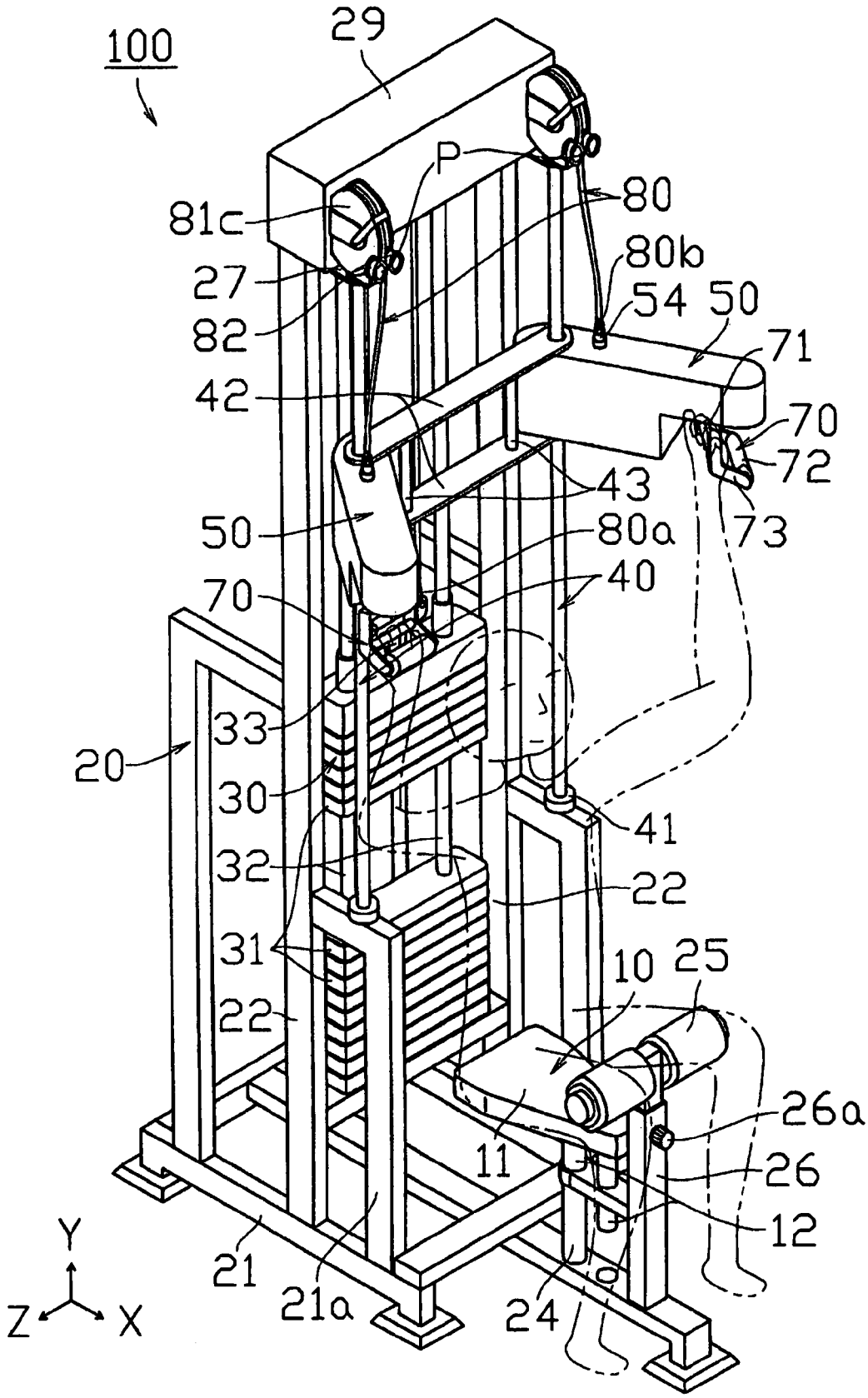
FIG. 3 is a perspective view illustrating a schematic appearance of the training apparatus 100 in a state that grip rotating parts 70 are moved downward from an initial state shown in FIG. 2.

A training apparatus 100 according to a first embodiment of the present invention is explained below. The training apparatus 100 is used for training the muscles of shoulder parts and a rear part, and as shown in FIGS. 2 and 3, has a seat part 10, a frame 20 which supports the seat part 10, a load application part 30 which is provided to the frame 20 and is designed so that the magnitude of a load can be adjusted, right and left guide poles 40 fixed to the frame 20 vertically (Y-axial direction in the drawing) with a predetermined interval so that the seat part 10 is in their center position, two lifting/oscillating parts (lifting parts) 50 whose one-side ends are fitted into the right and left guide poles 40, respectively, to be guided and provided movably in the vertical direction and rotatably in a horizontal direction (direction of XZ surface in the drawing), grip rotating parts (rotating parts) 70 connected to shafts 60 fixed to the other ends of the two lifting/oscillating parts 50, respectively, and are provided rotatably below the lifting/oscillating parts 50, pulling members 80 whose one-side ends 80*a* are connected to the load application part 30 and whose other ends 80*b* are connected to parts of the lifting/oscillating parts 50 closer to the other ends than the fitting positions of the guide poles 40, and load transmission parts 90 (see FIG. 4) connected to the other ends 80*b* of the pulling members 80 in the lifting/oscillating parts 50, and apply a load to the rotation of the grip rotating parts 70 about the shafts 60 by means of the load application part 30.

The seat part 10 is composed of a seat 11 which is suitable for a user (shown by alternate long and two short dashes line in FIG. 2) who uses the training apparatus 100 and sits facing a front direction (X-axial direction in the drawing), and two seat poles 12 provided vertically to the lower surface of the seat 11.

The frame 20 is composed of a lower frame 21 whose at least four corners are placed on a floor surface, two vertical poles 22 fixed vertically to both sides of the frame 21 with predetermined right and left intervals being spaced, and an upper frame 23 (see FIG. 5) which is supported and fixed to the two vertical poles 22. The seat part 10, the load application part 30, the right and left guide poles 40 and direction shift guide wheels 81 are supported and fixed to the frame 20.

One seat pole 12 is inserted into a cylindrical pipe material 24 provided vertically to a center part of the horizontal direction (Z-axial plus-minus direction the drawing) of the lower frame 21 from an upper end of the cylindrical pipe material 24, and the other seat pole 12 is inserted into a hole which penetrates to be installed on a member extending from an upper front surface of the cylindrical pipe material 24 to a front side in the vertical direction, so that the seat part 10 is supported to the frame 20. A seat height adjusting unit (not shown) can change a fixed height of the seat poles 12 with respect to the cylindrical pipe material 24 so as to be capable of suitably adjusting the height of the seat 11 according to a user's seated height.

The frame 20 supports a femoral region retaining part 25 which prevents the femoral regions of the user sat on the seat 11 from lifting up. The femoral retaining part 25 is preferably provided in order to suitably arch the user's rear during the training, and is made of a pair of right and left cylindrical cushion members whose peripheral surfaces are covered with a cushioned material. A pole which is provided between the paired cushion members is inserted into an upper end of a prismatic pipe material 26 provided vertically to the upper surface of the lower frame 21 at the front side with respect to the cylindrical pipe material 24, so that the femoral region retaining part 25 is supported to the frame 20. A femoral region height adjusting unit 26*a* can change the fixed height of the femoral region retaining part 25 with respect to the prismatic pipe material 26, so as to be capable of suitably adjusting the height of the femoral region retaining part 25 according to the user's seated height and the thickness of the femoral regions independently from the seat height 11. The frame 20 is constituted by processing a prismatic pipe material or a plate-shaped material made of metal such as iron and steel, and aluminum and fixing it by means of a bolt or weld, but it may be formed integrally by resin or the like.

The load application part 30 is provided to the frame 20 and can adjust the magnitude of the load, and has weights 31 made of plural plates as weight members made of metal, weight guide poles 32 which support the weights 31 to the frame movably up and down, and a clamp (not shown) which can connect and separate the weights 31 to/from one another. The paired cylindrical weight guide poles 32 extend vertically with predetermined intervals being spaced in an horizontal direction between the two vertical poles 22 at the rear of the seat part 10, and their upper and lower ends are fixed to the lower frame 21 and the upper frame 23, respectively. The plates of the weights 31 are laminated so that the weight guide poles 32 are inserted into their through holes, and they are supported to the weight guide poles 32 movably up and down. The clamp can connect the desired number of weights 31 counted from the top integrally. The number of the weights 31 to be connected by the clamp is adjusted, so that the loads of the load application part 30 due to the weight of the weights 31 to be pulled up can be gradually adjusted. A shock absorbing member (not shown) having elasticity for relaxing a shock or the like is provided between the bottom plate and the frame 20.

The right and left guide poles 40 are respective cylindrical members which extend vertically with a predetermined interval slightly wider than a user's shoulder width being spaced horizontally so that the seat part 10 is their center position. As to the guide poles 40, their lower ends are fixed to connecting members 21*a* for connecting the upper frame 21 and the vertical pillars 22, and their upper ends are fixed to L-shaped members 27 fixed to the upper frame 23 at the rear of the seat part 10 and at the front of the weight guide poles 32. Shock absorbing members 41 having elasticity for relaxing shocks or the like due to collision between the lifting/oscillating parts 50 guided and moved up and down by the guide poles 40 and the connecting members 21*a* are provided to the connecting members 21*a* to which the lower ends of the guide poles 40 are fixed.

Figure 4:
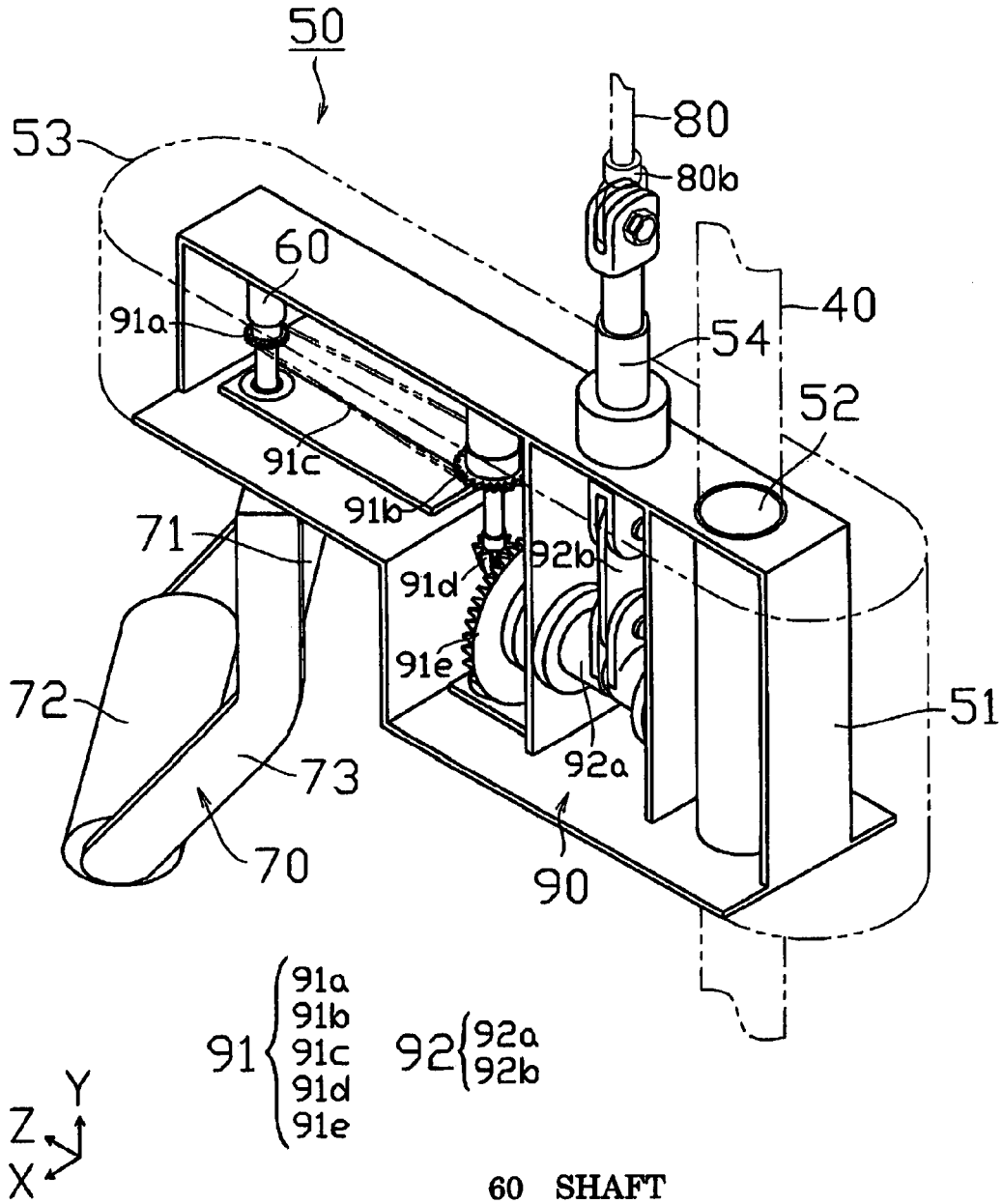
FIG. 4 is a schematic perspective view illustrating a constitution of lifting/oscillating parts 50.

The right and left guide poles 40 are fitted into one-side ends (rear sides, X-axial minus side in the drawing) of the two lifting/oscillating parts 50 so that the parts 50 are guided and are provided movably in the vertical direction and rotatably in the horizontal direction. Each of the lifting/oscillating parts 50 has, as shown in FIG. 4, a cylindrical guide part 52 which opens in the vertical direction at one end of a frame body 51, and the lifting/oscillating part 50 is covered with a box-shaped cover body 53 for safety. When the guide pole 40 is fitted into the guide part 52, the lifting/oscillating part 50 freely moves vertically with respect to the guide pole 40, and the lifting/oscillating part 50 freely rotates about the guide pole 40 horizontally. As shown in FIGS. 2 and 3, two horizontal connecting plates 42 are provided to upper parts and lower parts of the lifting/oscillating parts 50 via bearing members (not shown) such as bearings. The guide poles 40 are inserted through two through holes provided to each of the horizontal connecting plates 42, and the horizontal connecting plates 42 are connected by connecting bars 43 so as to be fixed horizontally with a predetermined interval being spaced in the vertical direction. As a result, the independent movements of the two lifting/oscillating parts 50 in the vertical direction are regulated by the horizontal connecting plates 42 so as to move up and down. Since the bearing members intervene between the lifting/oscillating parts 50 and the horizontal connecting plates 42, the independent movements of the two lifting/oscillating parts 50 in the vertical direction are allowed within a predetermined range, so that the two lifting/oscillating parts 50 can smoothly move up and down. The horizontal rotation of the lifting/oscillating parts 50 is not disturbed by the horizontal connecting plates 42 and the bearing members.

As shown in FIGS. 1 and 2, the two grip rotating parts 70 are gripped by a user with hands, and are provided rotatably below the lifting/oscillating part 50 so as to be connected to the shafts 60 fixed to the other ends (front side, the X-axial plus side in the drawing) of the lifting/oscillating parts 50. Each of the grip rotating parts 70 has a handle part 71 on which user's fingers are put, a back-of-hand pad part 72 to which the back of the user's hand is applied, and a frame body 73 which supports the handle part 71 and the back-of-hand pad part 72. The handle part 71 has a cylindrical shape, and fingers other than a thumb are put thereon. The back-of-hand pad 72 protects the back of the user's hand and the back of the user's wrist in a suitable position below the handle part 71, and has a cylindrical shape whose peripheral surface is covered with a cushioned material. The frame body 73 supports to fix the handle part 71 and the back-of-hand pad 72 at its both ends, and as shown in FIG. 4, the shaft 60 is fixed to the upper surface of the frame body 73. The shaft 60 is pivotally supported to the lifting/oscillating part 50 via a bearing provided to an upper wall and a lower wall of the frame body 51 of the lifting-oscillating part 50. As a result, each of the grip rotating parts 70 can be axially rotated to the horizontal direction with respect to the lifting/oscillating parts 50. As to each of the grip rotating parts 70, the back-of-hand pad part 72 is positioned in an approximately front direction with respect to the handle part 71 so that the back of the user's hand gripping the grip rotating part 70 faces the approximately front direction in an initial state shown in FIG. 2. The grip rotating parts 70 are in a position higher than the stretched-up hands of the user sat on the seat 11 together with the lifting/oscillating parts 50 by means of the function of the load application part 30 in the initial state. On the other hand, the grip rotating parts 70 can be descended until the lifting/oscillating parts 50 touch the shock absorbing members 41 provided to the bottom ends of the guide poles 40 against the function of the load application part 30. In this state, the grip rotating parts 70 are positioned below the shoulder parts of the user sat on the seat 11.

The two pulling members 80 are two long ropes and one-side ends 80*a* are connected to the weights 31. The plate positioned at the top of the weights 31 has a T-shaped rope fixing part 33 on its upper surface, and the one-side ends 80*a* of the pulling members 80 are tightened to both ends of the upper horizontal material of the rope fixing part 33. The pulling members 80 are not limited to the ropes, and may be another members such as chain. The rope fixing part 33 is not limited to T shape, but it may have another shape.

Figure 5:
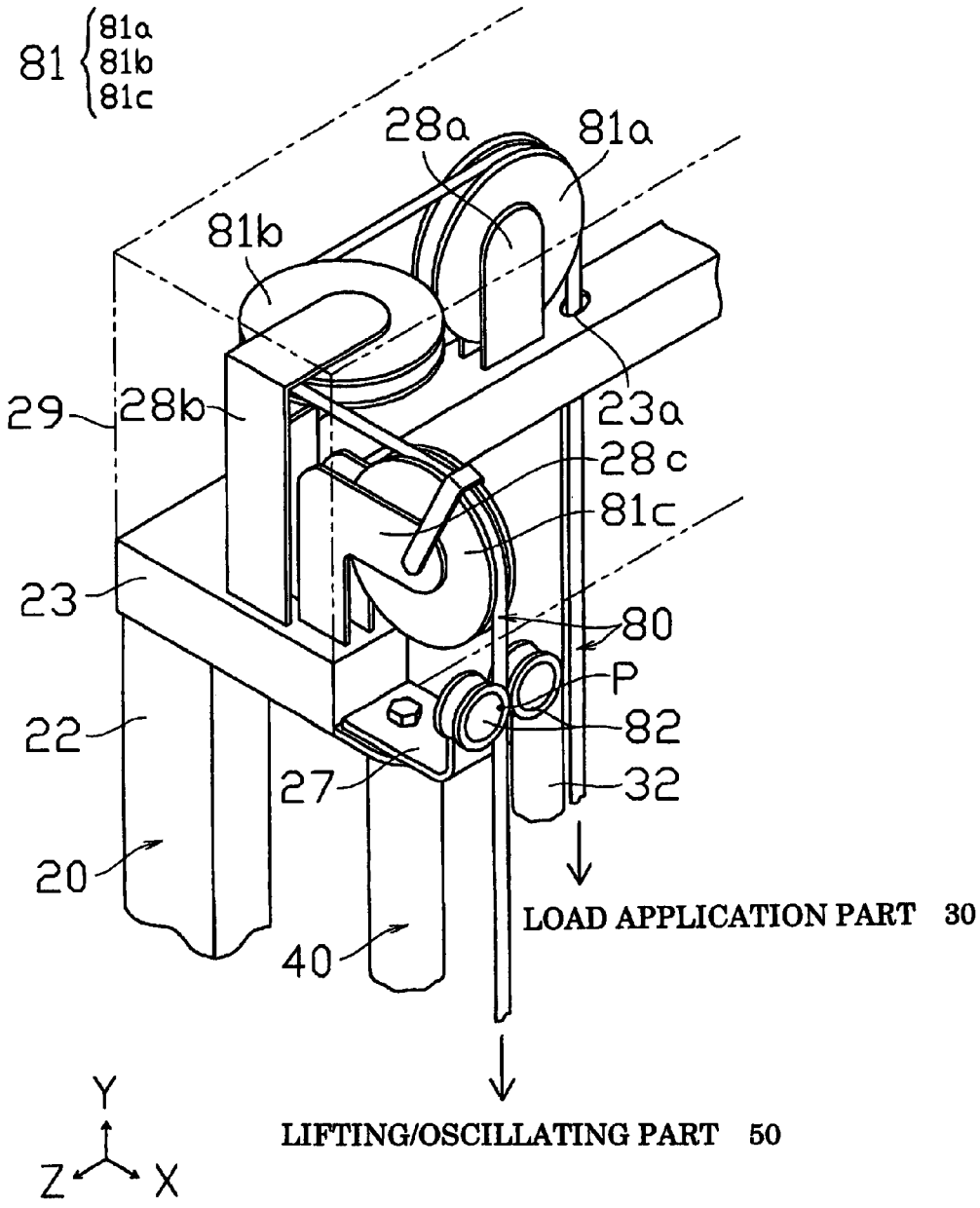
FIG. 5 is a partially schematic perspective view illustrating an upper left part of the training apparatus 100.

The pulling members 80 whose one-side ends 80*a* are fixed to the weights 31 composing the load application part 30 are wound around the direction shift guide wheels 81, respectively. As shown in FIG. 5, the direction shift guide wheel 81 is composed of a plurality of pulleys 81*a*, 81*b* and 81*c*, and shifts the loads to the down direction applied to the pulling members 80 by the weights 31 into the loads to the up direction. That is to say, the pulleys 81*a*, 81*b* and 81*c* are pivotally supported to pivotally supporting members 28*a*, 28*b* and 28*c* provided to the upper surface of the upper frame 23, respectively, and the pulling member 80 is wound around the pulleys 81*a*, 81*b* and 81*c* in this order. After the pulling member 80 which extends upward from the load application part 30 (Y-axial plus direction) is inserted into a hole 23*a* which penetrate to be installed on the upper frame 23, the direction of the pulling member 80 is shifted to an outward direction in the horizontal direction (Z-axial plus-minus direction) by the first pulley 81*a* pivotally supported rotatably on an YZ plane. Thereafter, the direction is shifted to a front direction (X-axial plus direction) by the second pulley 81*b* pivotally supported rotatably on an XZ plane, and is shifted to a downward direction (Y-axial minus direction) by the third pulley 81*c* pivotally supported rotatably on an XY plane so as to extend downward. The box-shaped cover member 29 (shown by the alternate long and two short dashes line in the drawing) mounted to the upper frame 23 from above covers the pulleys 81*a*, 81*b* and 81*c* so as to prevent rolling-in, but a part of the third pulley 81*c* is exposed to the front side through the opening. The number of the pulleys 81*a*, 81*b* and 81*c* can be reduced according to a positional relationship of the weight guide poles 32 and the guide poles 40.

A pair of grooved rollers 82 are provided so as to regulate the horizontal transfer of the pulling member 80 extended down by the shift of the direction to the downward direction by means of the third pulley 81*c*, and allow the pulling member 80 to always go through a predetermined position P. The paired grooved rollers 82 rotatable with respect to the YZ plane are provided in parallel in the horizontal direction just below the third pulley 81*c* so that the pulling member 80 goes through the position P in a interval formed by the grooves of the grooved rollers 82. The grooved rollers 82 are pivotally supported to the frame 20 by the L-shaped member 27 in a cantilevered fashion. As shown in FIG. 5, the L-shaped member 27 is an approximately L-shaped member, and the L-shaped member 27 and the upper end of the guide pole 40 are co-fastened so as to be fixed to the upper frame 23. The load application part 30 applies the load due to the weights 31 connected by the clamp so that the other end 80*b* of the pulling member 80 is pulled up towards the position P.

As shown in FIGS. 2 and 3, the other ends 80*b* of the pulling members 80 are connected to the part (front side, X-axial plus side in the drawing) of the lifting/oscillating parts 50 closer to the other ends than the fitting positions of the guide poles 40. That is to say, as shown in FIG. 3, sliding shafts 54 provided on the parts of the lifting/oscillating parts 50 closer to the other ends than the guide parts 52 through which the guide poles 40 are inserted with a predetermined interval are connected to the lifting/oscillating parts 50 so as to be movable up and down and slidable within a predetermined range. When the load application part 30 and the sliding shafts 54 of the lifting/oscillating parts 50 are connected via the direction shift guide wheels 81 by the pulling members 80, the load application part 30 applies the loads so as to pull up the sliding shafts 54 towards the position P. As a result, the lifting/oscillating parts 50 are biased to the upward direction (Y-axial plus direction in the drawing) by the loads of the load application parts 30 via the sliding shafts 54. The lifting/oscillating parts 50 are provided rotatably about the guide poles 40, but when the sliding shafts 54 shift from a lower portion of the position P in the horizontal direction, the lifting/oscillating parts 50 are rotatably biased by the loads of the load application parts 30 so that the sliding shafts 54 are below the position P in the horizontal direction, namely, the lifting/oscillating parts 30 face the front direction.

Since the pulling members 80 are regulated by the grooved rollers 82 so as to go through the positions P, when distances between the positions P and the sliding shafts 54 are short, for example, in the case of the initial state of FIG. 2, the rotation of the lifting/oscillating parts 50 is regulated so that they cannot be practically rotated. On the other hand, when the distances between the positions P and the sliding shafts 54 are large, for example as shown in FIG. 3, when the lifting/oscillating parts 50 are positioned lower than the initial state, the user can rotate the lifting/oscillating parts 50 by a predetermined angle against the forces for rotatably biasing the lifting/oscillating parts 50 in order to turn them to the front direction. The forces for rotatably biasing the lifting/oscillating parts 50 in order to turn them to the front direction are proportional to the loads of the load application part 30, and are approximately inversely proportional to the distances between the positions P and the lifting/oscillating parts 50.

The load transmission parts 90 apply the forces of the load application part 30 to the shafts 60 of the grip rotating parts 70, and as shown in FIG. 4, have a rotation transmission part 91 which transmits the rotation about the shaft 60 of the grip rotating part 70, and a crank mechanism part 92 which converts the rotation transmitted by the rotation transmission part 91 into an up and down movement of the sliding shaft 54 connected to the other end of the pulling member 80. When the grip rotating part 70 is axially rotated with respect to the lifting/oscillating part 50, the sliding shaft 54 moves up and down via the rotation transmission part 91 and the crank mechanism part 92 so that the weights 31 connected by the clamps (not shown) move up and down.

The rotation transmission part 91 has a sprocket 91*a* provided to the shaft 60 of the grip rotating part 70 in the lifting/oscillating part 50, a sprocket 91*b* provided to a shaft whose upper and lower ends are pivotally supported to the frame body 51, a chain 91*c* set across the sprocket 91*a* and the sprocket 91*b*, a bevel gear 91*d* which is provided to the shaft provided with the sprocket 91*b*, and a bevel gear (crown gear) 91*e* which gears with the bevel gear 91*d*. The bevel gear 91*e* is provided to a free end of a crank shaft 92*a* pivotally supported to the frame body 53 horizontally on the side of the grip rotating part 70. As a result, the crank shaft 92*a* rotates by means of the horizontal rotation of the shaft 60 of the grip rotating part 70. On the other hand, the crank mechanism part 92 has the crank shaft 92*a*, and a connecting piece 92*b* whose one end is connected rotatably to a protrusion protruded from a center of the crank shaft 92*a* and whose other end is connected rotatably to a lower end of the sliding shaft 54. As a result, the sliding shaft 54 moves up and down by means of the rotation of the crank shaft 92*a*. The grip rotating part 70 is rotationally biased by the force which is proportional to the load of the load application part 30 so as to face the front direction. The grip rotating part 70 is axially rotated from the approximately front direction as the initial direction to the outwardly horizontal direction with respect to the lifting/oscillating part 50 against the rotational biasing force, so that the sliding shaft 54 slides down with respect to the lighting/oscillating part 50, and the weights 31 connected by the clamp are pulled up.

A training method using the training apparatus 100 is explained below with reference to FIGS. 2 and 3.

The suitable number of weights 31 are connected by the clamp (not shown) so that the suitable weight becomes the load of the load application part 30 according to the load suitable for the muscle strength and objects of a user. The user faces front and sits on the seat 11 and adjusts to fix the seat 11 to a suitable height so that the bottoms of user's feet touch the floor surface. The femoral region retaining part 25 is adjusted and fixed to a suitable height so as to contact with the upper surfaces of the femoral regions of the user sat on the seat 11. The user trains with the user's back being arched.

The user stands up, turns the backs of user's hands to the front according to the initial state of the respective grip rotating parts 70 facing the front, puts the fingers other than the thumbs on the handle parts 71, and grips the grip rotating parts 70 so that the back of hands and the rears of the wrists touch the back-of-hand pad parts 72. While gripping the grip rotating parts 70 with the hands stretched up and pulling the grip rotating parts 70 down, the user faces the front and sits on the seat 11.

The user twists both upper arms outward against the forces for rotationally biasing the grip rotating parts 70 in order to turn the grip rotating parts 70 to the front direction by means of the forces proportional to the loads of the load application part 30, axially rotates the grip rotating parts 70 to an outwardly horizontal direction with respect to the lifting/oscillating parts 50, and turns the back of hands gripping the grip rotating parts 70 to an outer direction with respect to the front direction. When the user is in this "dodge movement" position, both the flexor muscles and the extensor muscles are "relaxed" so that the shoulders and arms are relaxed. Since the grip rotating parts 70 are biased also to the up direction by the loads of the load application part 30, the muscles near shoulder girdle are suitably "stretched".

The user bends both arms against the loads of the load application part 30 so that the suitably stretched muscles near the shoulder girdle are "reflected", and "contracts" the muscles so as to pull the grip rotating parts 70 down. At this time, while further making the "relaxing" and "stretching" movement to twist the upper arms outward, the user pulls the grip rotating parts 70 down with both hands. When the grip rotating parts 70 are axially rotated to the outwardly horizontal direction with respect to the lifting/oscillating parts 50 by the movement for twisting the upper arms outward, the weights 31 are pulled up, so that the load on the first movement for pulling down both arms is reduced. When both the arms are bent to pull the grip rotating parts 70 down and "contract" the muscles, the upper arms are further twisted outward, and while the "relaxing" and "stretching" movements are being made so that the suitable "contracting" timing is allowed to appear. As a result, the respective muscle groups obtain the "relaxing-stretching-contracting" timing, so that the movements can be made in good cooperation.

When the user bends both arms to pull the grip rotating parts 70 down, the user gradually widens both the arms outward against the force for rotationally biasing the lifting/oscillating parts 50 to the front so that the lifting/oscillating parts 50 face outward. Since the force for rotationally biasing the lifting/oscillating parts 50 to the front is approximately inversely proportional to the distance between the positions P and the lifting/oscillating parts 50, when both arms are bent to pull the grip rotating parts 70 down, the resistant force against the widening both arms outward is reduced. For this reason, when the user bends both the arms to pull the grip rotating parts 70 down, the user outputs approximately constant muscle strength to widen both arms outward, so as to pull the grip rotating parts 70 down and simultaneously be capable of smoothly and gradually widening both arms outward. As a result, the co-contraction of the muscles can be prevented.

After pulling down the grip rotating parts 70 to approximately the height of shoulder parts, the user twists the upper arms inward and stretches both arms with them being closed inward according to the biasing forces due the loads of the load application part 30, and while gripping the grip rotating part 70 with the backs of the hands facing the front, returns to the seated state. As a result, one cycle of the training is completed. The suitable cycle number of the training is repeated.

The training apparatus 100 can suitably train the muscles of shoulder parts and rear parts according to the beginning movement load training. The beginning movement load training should be conducted after the entire movement images, such as the point at which a load is applied the point and the angle and the rhythm at which the load is released, and the continuity of the muscle outputs, are obtained. Although it is difficult to take the suitable movements and forms due to the physical balance and partial hardening of a body at this stage, the series of training involving the ideal movements and forms are easily induced by the training apparatus 100.

Figure 6:
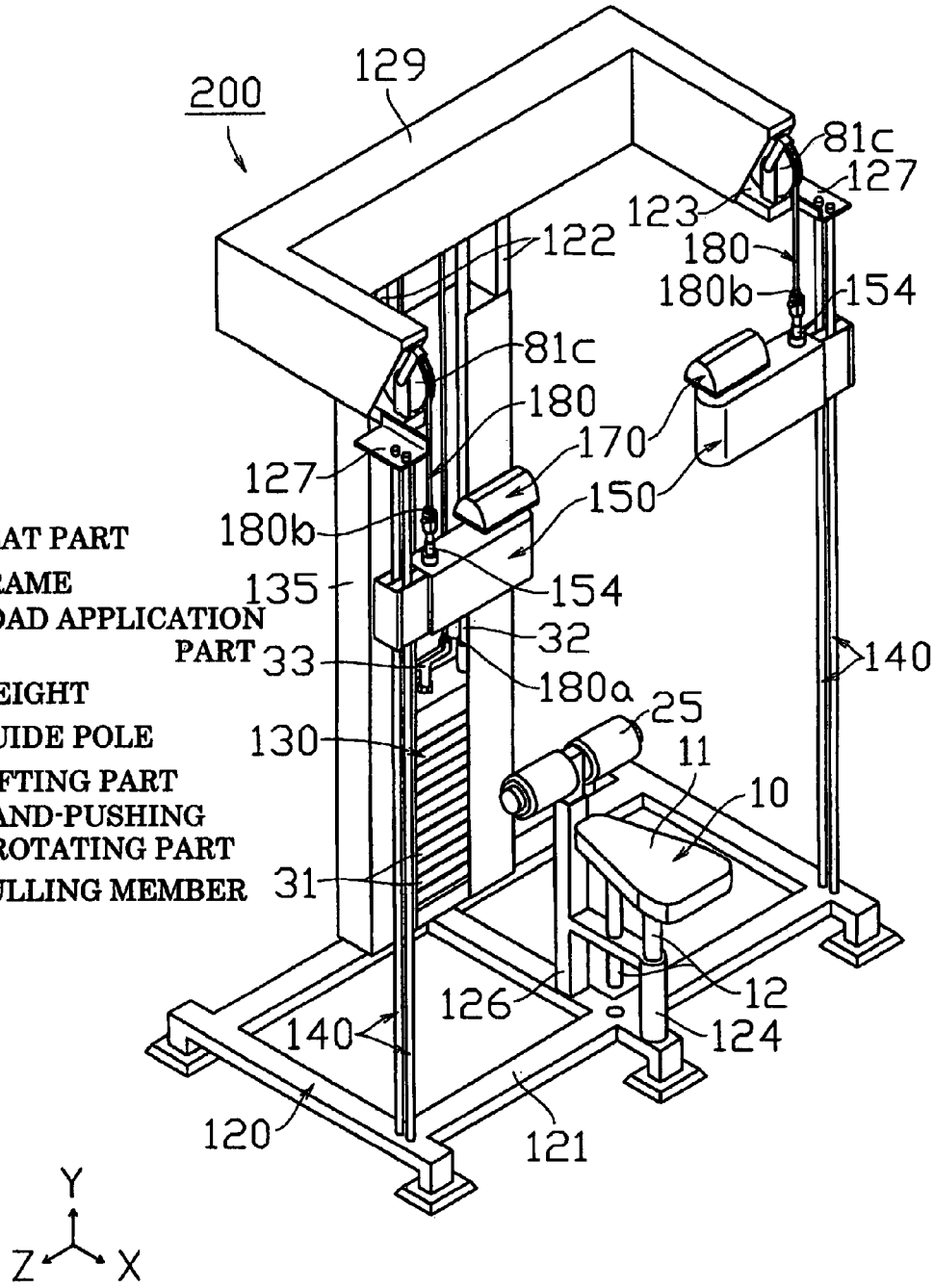
FIG. 6 is a perspective view illustrating a schematic appearance of a training apparatus 200 in an initial state according to a second embodiment of the present invention.
Figure 7:
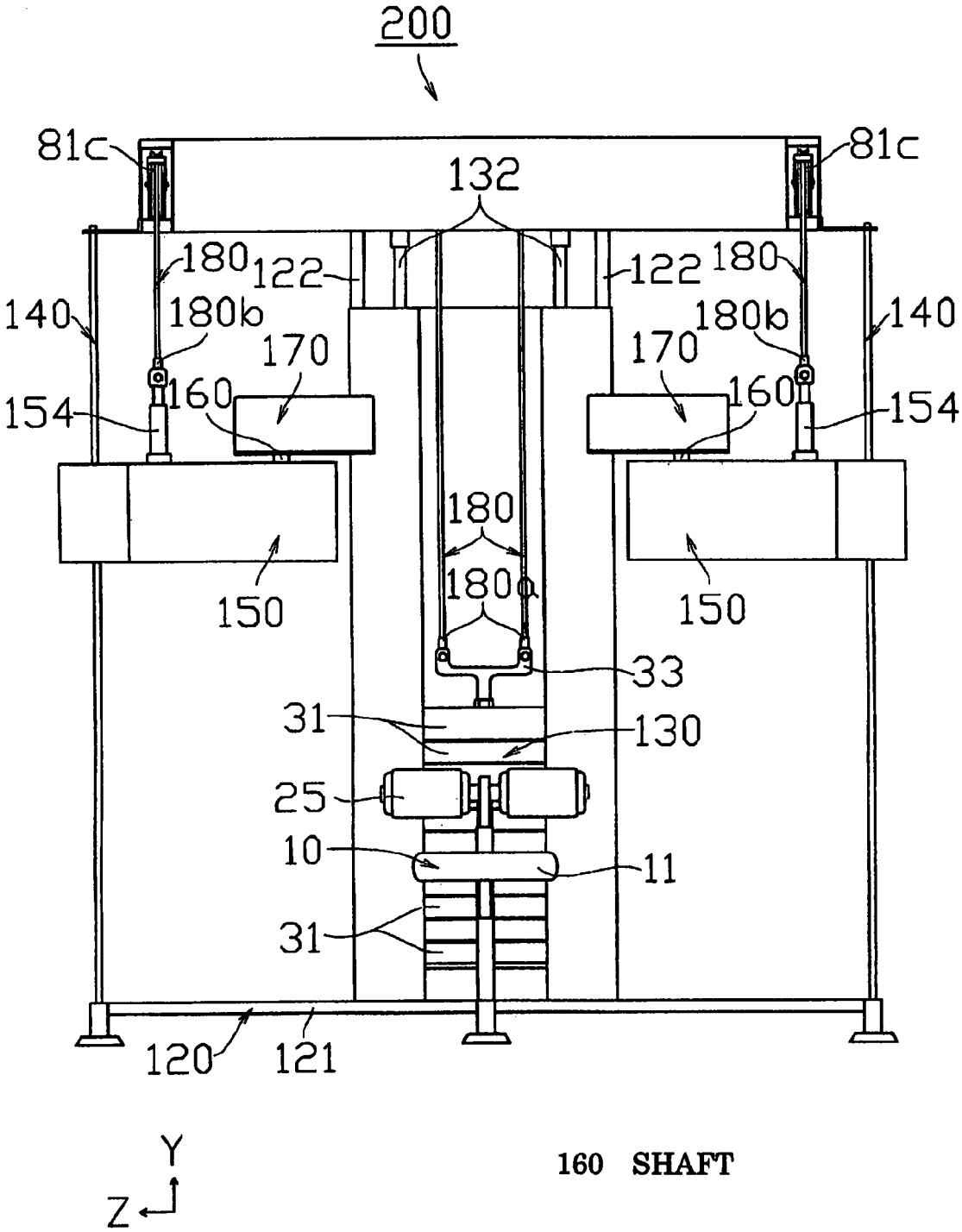
FIG. 7 is a front view illustrating a schematic appearance of the training apparatus 200 in the initial state.

A training apparatus 200 according to a second embodiment of the present invention is explained below. The training apparatus 200 is used for the training the muscles of shoulder parts, arm parts and rear part, and as shown in FIG. 6, has the seat part 10, a frame 120 which supports the seat part 10, a load application part 130 which is provided to the frame 120 and is designed so that the magnitude of a load can be adjusted, two right and left guide poles 140 which extend from the frame 120 to a vertical direction (Y-axial direction in the drawing) with a predetermined interval in the horizontal direction (Z-axial direction in the drawing) so that the seat part 10 is in their center position, two lifting parts 150 guided by the right and left guide poles 140 and a removable only to the vertical direction, hand-pushing rotating parts (rotating parts) 170 connected to shafts 160 (see FIG. 7) fixed to the two lifting parts 150 and are provided rotatably to upper parts of the lifting parts 150, respectively, pulling members 180 whose one-side ends 180*a* are connected to the load application part 130 and whose other ends 180*b* are connected to the lifting parts 150, and load transmission parts 90 (see FIGS. 10 and 11) connected to the other ends 180*b* of the pulling members 180 in the lifting parts 150, respectively, so as to apply loads to the rotation of the hand-pushing rotating parts 170 about the shafts 160 by means of the load application part 130.

The frame 120 is composed of a lower frame 121 whose at least four corners are placed on a floor surface, two vertical poles 122 fixed vertically to the rear part of the lower frame 121 with predetermined right and left intervals being spaced, and an upper frame 123 which is supported and fixed to the two vertical poles 122. The seat part 11, the loan application part 130, the right and left guide poles 140 and direction shift guide wheels 81 are supported and fixed to the frame 120.

One seat pole 12 of the seat part 10 is inserted into an upper end of a cylindrical pipe material 124 provided vertically to a portion of the lower frame 121 near a front end of a center portion in the horizontal direction, and the other seat pole 12 is inserted into a hole, which vertically penetrates to be installed on a member which extend backward from an upper rear surface of the cylindrical pipe member 124. As a result, the seat part 10 is supported to the frame 120 so that the user who uses the training apparatus 200 (shown by alternate long and two short dashes line in FIGS. 8 and 9) can face the rear (X-axial minus direction in the drawings) and sit on the seat 11. A seat height adjusting unit (not shown) can change a fixed height of the seat poles 12 with respect to the cylindrical pipe members 124 so as to be capable of suitably adjusting the height of the seat 11 according to a user's seated height.

When a pole of the femoral region retaining part 25 is inserted into an upper end of a prismatic pipe material 126 provided vertically to the upper surface of the lower frame 121 at the rear side with respect to the cylindrical pipe material 124, the femoral region retaining part 25 is supported to the frame 120. The frame 120 is constituted by processing a prismatic pipe material or a plate-shaped material made of metal such as iron and steel, and aluminum and fixing it by means of a bolt or weld, but it may be formed integrally by resin or the like.

The load application part 130 is provided to the frame 120 and can adjust the magnitude of the loads, and similarly to the load application part 30 of the training apparatus 100, has weights 31 made of plural plates, weight guide poles 132 which support the weights 31 to the frame 120 movably up and down, and a clamp (not shown) which can connect and separate the weights 31 to/from one another. The paired weight guide poles 132 extend vertically with predetermined intervals being spaced in the horizontal direction between the two vertical poles 122, and their upper and lower ends are fixed to the lower frame 121 and the upper frame 123, respectively. A weight cover plate 135 which externally covers the load application part 130 and the two vertical poles 122 is provided for safety, and when the number of the weights 31 to be connected by the clamp is adjusted through the opening of the weight cover plate 135, so that the loads of the load application part 130 due to the weight of the weights 31 to be pulled up can be gradually adjusted.

The right and left guide poles 140 are two right and left cylindrical members which extend vertically with a predetermined interval being spaced horizontally and a predetermined interval being spaced also in a front-rear direction so that the seat part 10 is in their center position. As to the guide poles 140, their lower ends are fixed to the lower frame 121 and their upper ends are fixed to L-shaped members 127 fixed to the upper frame 123.

Figure 10:
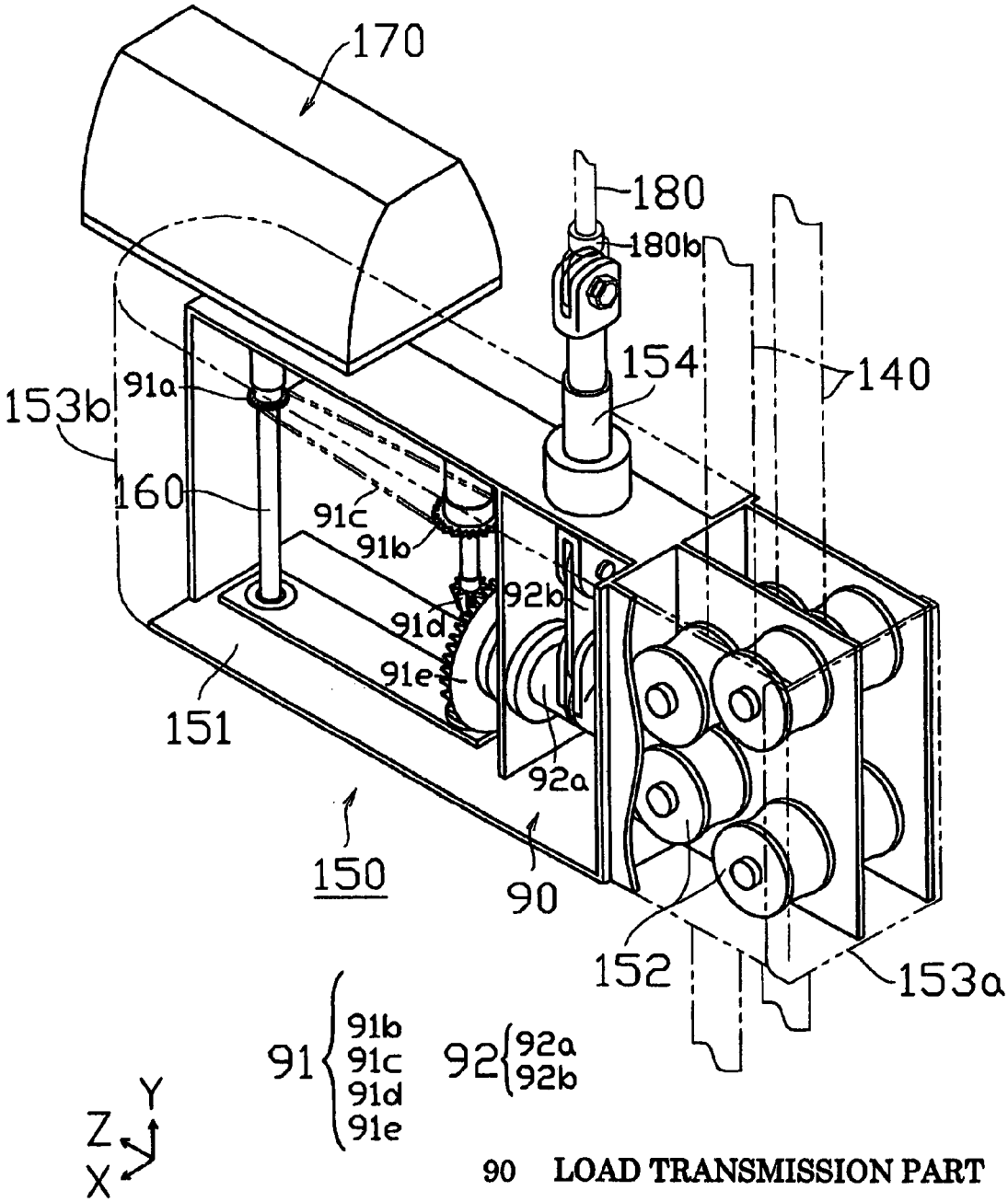
FIG. 10 is a portion fracture perspective view illustrating a schematic constitution of a lifting part 150.
Figure 11:
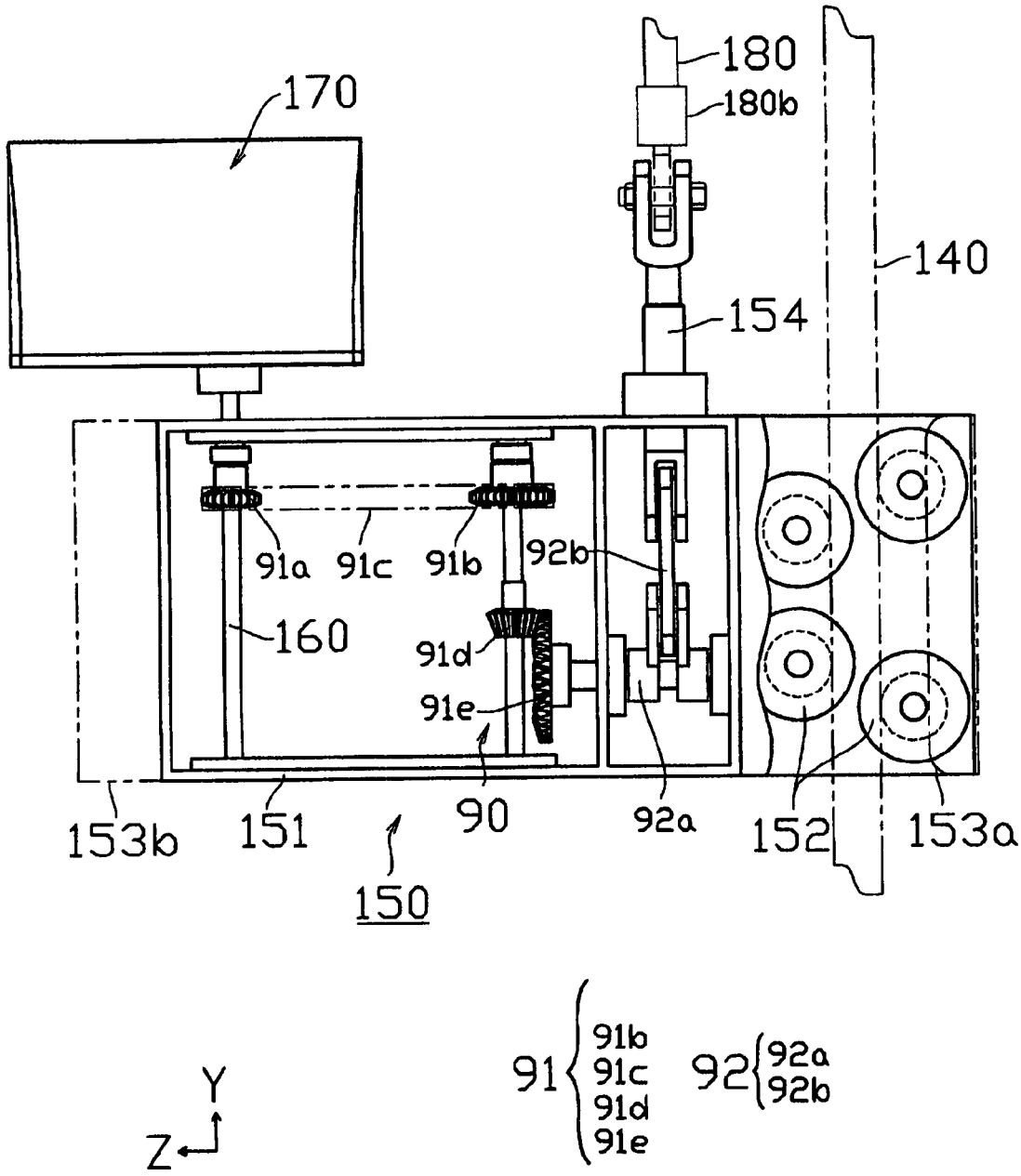
FIG. 11 is a portion fracture front view illustrating the schematic constitution of the lifting part 150.

On-side ends (outside in the horizontal direction) of the two lifting parts 150 are guided by the right and left guide poles 140, respectively, and the lifting parts 150 are movable only vertically. In each of the lifting parts 150, as shown in FIGS. 10 and 11, a plurality of oscillating part guide wheels 152 are pivotally supported to one end of a frame body 151, and their horizontal part is externally covered with a cover material 153*a* and their vertical part is covered with a cover material 153*b* for safety. Two sets of the plural lifting part guide wheels 152 which rotate in the vertical plane (YZ plane in the drawing) are pivotally supported to inter-wall which extends vertically at one end of the frame body 151. One guide pole 140 is positioned in a interval in the vertical direction (Y-axial direction in the drawing) formed by the respective grooves of one set of the lifting guide wheels 152 rotating in the vertical plane, so that the movements of the lifting parts 150 to the horizontal and front-rear directions are approximately regulated. One lifting part 150 is provided with two sets of the plural lifting part guide wheels 152 and is guided by the two guide poles 140, so that the rotation of the lifting part 150 in the horizontal direction (XZ plane direction in the drawing) is approximately regulated. When the lifting part 150 internally touches the two vertical guide poles 140 to be guided by them, it freely moves vertically but the transfer and rotation in the horizontal direction are regulated.

Figure 8:
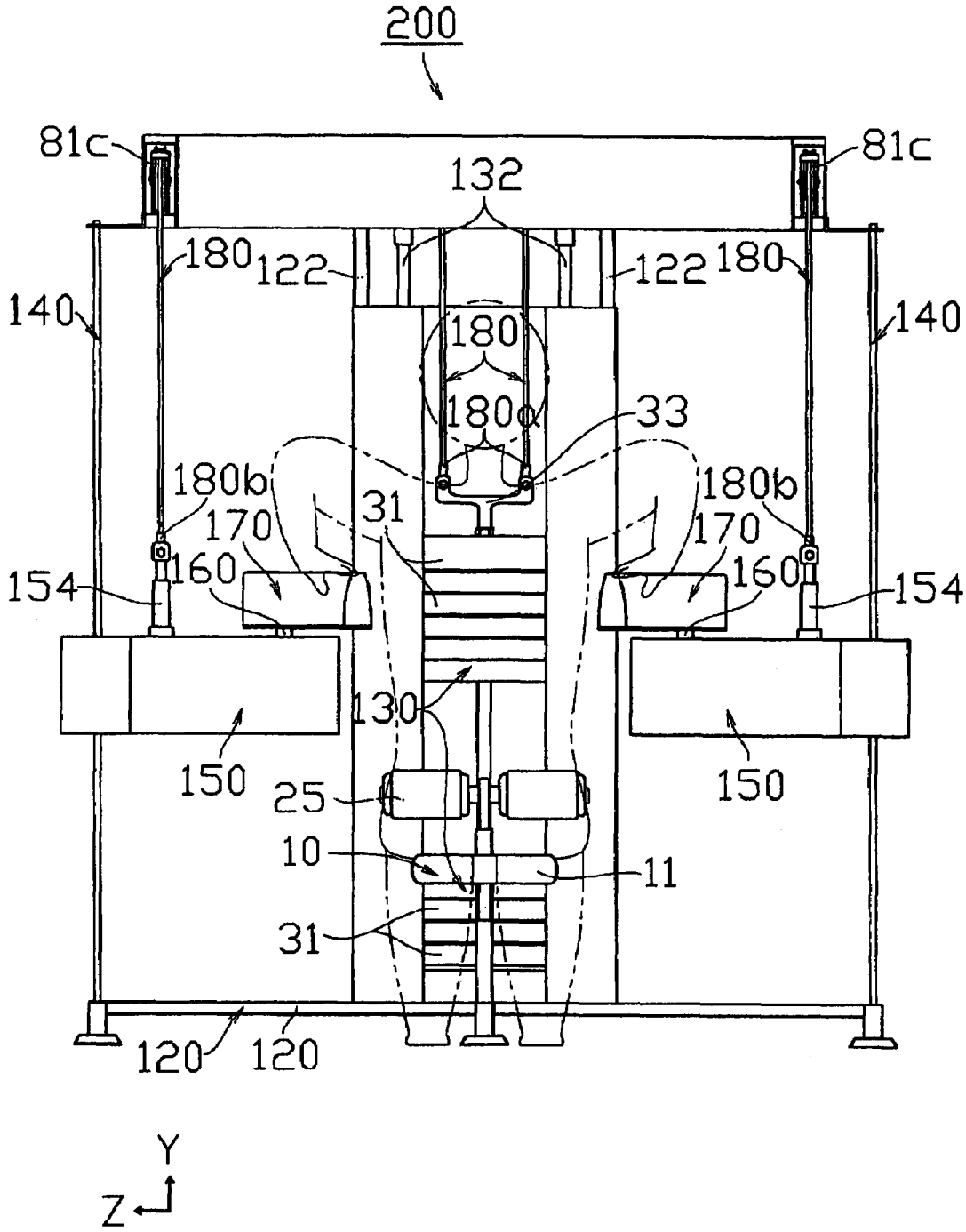
FIG. 8 is a front view illustrating a schematic appearance of the training apparatus 200 in a state that training is started and hand-pushing rotating parts 170 are axially rotated.
Figure 9:
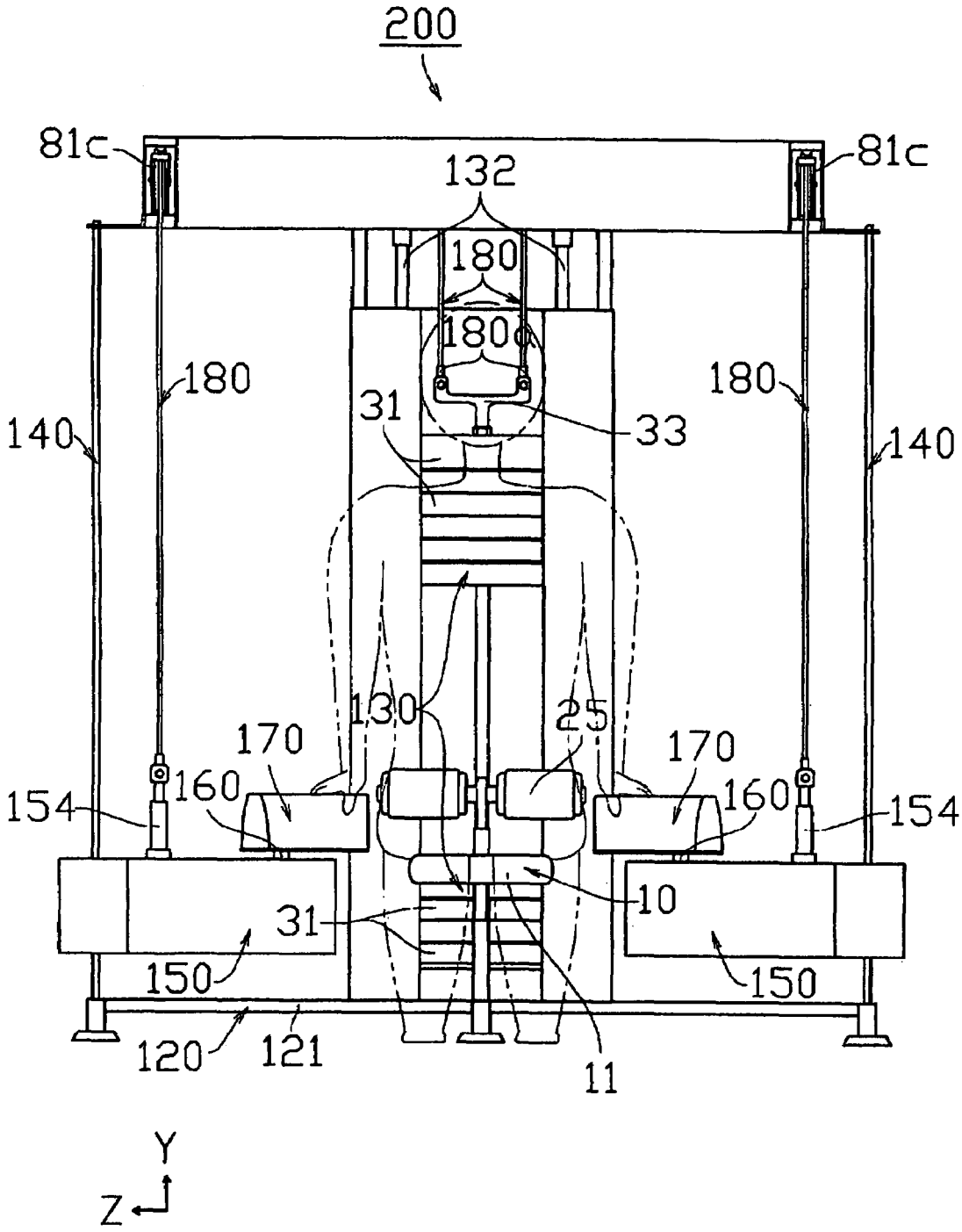
FIG. 9 is a front view illustrating a schematic appearance of the training apparatus 200 in a state that the hand-pushing rotating parts 170 are pushed down.

The two hand-pushing rotating parts 170 are, as shown in FIGS. 8 and 9, gripped and pushed by user's hands, and are connected to the upper portions of the vertical shafts 160 fixed to the other ends of the lifting parts 150 to be provided rotatably above the lifting parts 150, respectively. The hand-pushing rotating parts 170 move up and down together with the lifting parts 150. The hand-pushing rotating parts 170 have a dome shape which is suitable for the user's gripping and pushing, and are made of cushioned materials. As shown in FIGS. 10 and 11, the shaft 160 is pivotally supported to the lifting part 150 via a bearing provided to an upper wall and a lower wall of the frame body 151 of the lifting part 150. As a result, the hand-pushing rotating parts 170 can be axially rotated to the horizontal direction with respect to the lifting part 150. The hand-pushing rotating parts 170 are positioned so that the other ends separated from the shafts 160 are opposed with them facing an approximately center in the horizontal direction in the initial state of FIGS. 6 and 7. The hand-pushing rotating parts 170 as well as the lifting parts 150 are in positions above the shoulders of the user sat on the seat 11 by means of the function of the load application part 130 in the initial state. On the other hand, in a state that the hand-pushing rotating parts 170 are descended to the bottom against the function of the load application part 130, the hand-pushing rotating parts 170 can be positioned near or below the waist part of the user sat on the seat 11.

The two pulling members 180 are two long ropes and one-side ends 180*a* are connected to the weights 31. The plate positioned at the top of the weights 31 has a T-shaped rope fixing part 33 on its upper surface, and the one ends 180*a* of the pulling members 180 are tightened to both ends of the upper horizontal material of the rope fixing part 33. The pulling members 180 are not limited to the ropes, and may be another members such as chain. The rope fixing part 33 is not limited to T shape, but it may have another shape.

Figure 12:
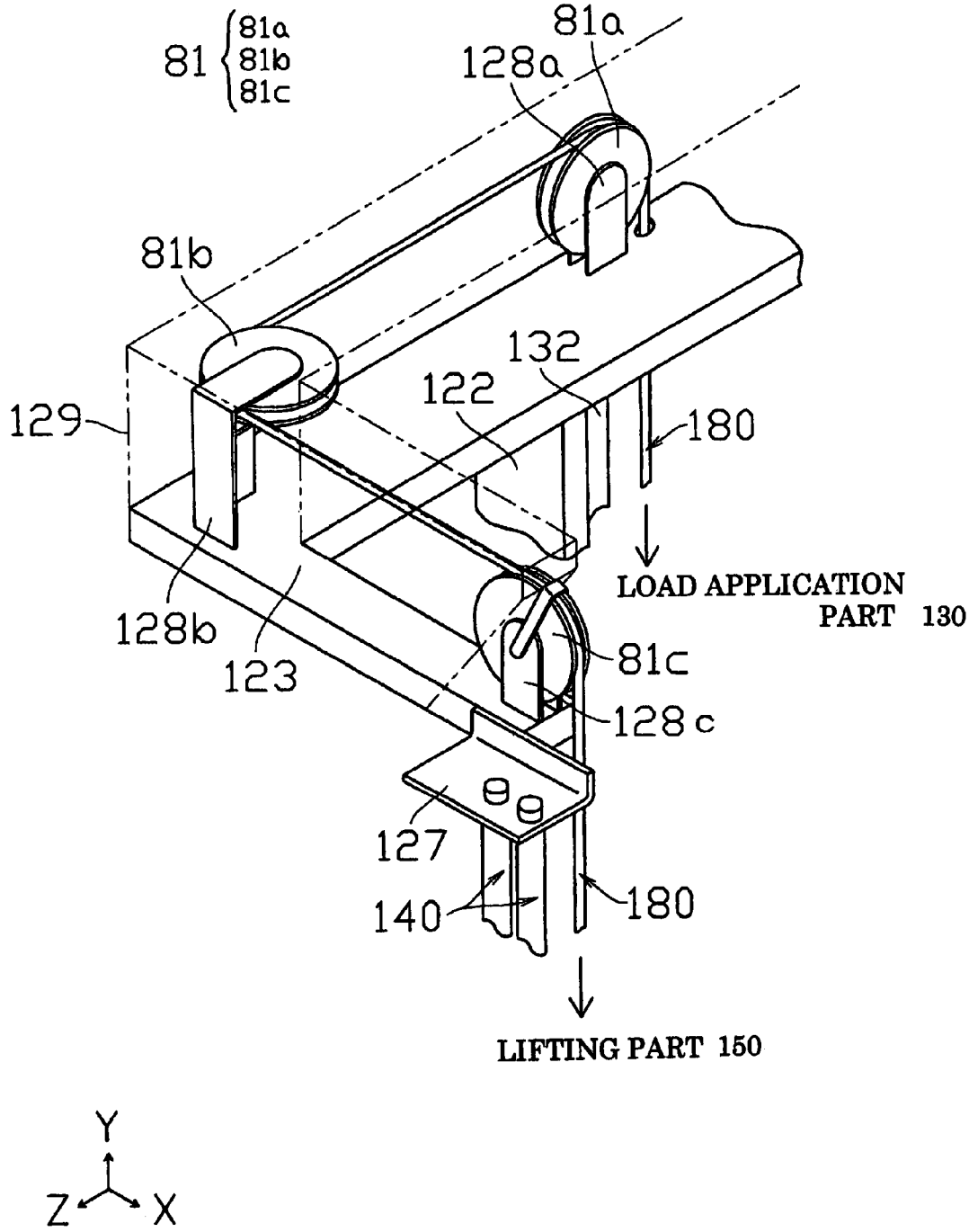
FIG. 12 is a perspective view illustrating a schematic constitution of an upper left portion of the training apparatus 200.

The pulling members 180 whose one ends 180*a* are fixed to the weights 31 composing the load application part 130 are wound around the direction shift guide wheels 81, respectively. The direction shift guide wheel 81 is, as shown in FIG. 12, composed of a plurality of pulleys 81*a*, 81*b* and 81*c* (respectively held in supporting members 128*a*, 128*b*, and 128*c*), and shifts the downward load applied to the pulling member 80 by the weights 31 into the upward load. A box-shaped cover member 129 (shown by the alternate long and two short dashes line in the drawing) mounted to the upper frame 23 from above covers the pulleys 81*a*, 81*b* and 81*c* so as to prevent rolling-in, but a part of the third pulley 81*c* is exposed to the front side through the opening. The number of the pulleys 81*a*, 81*b* and 81*c* can be reduced according to the positional relationship of the weight guide poles 132 and the guide poles 140.

On the other hand, the other ends 180*b* of the pulling members 180 are, as shown in FIG. 6, connected to parts of the lifting parts 150 closer to the other ends than the internal touching position of the guide poles 140, respectively. That is to say, as shown in FIGS. 10 and 11, a sliding shaft 154 which is slidable and movable up and down within a predetermined range is provided to a part of the lifting part 150 closer to the other end than the internal touching position of the guide pole 140 with a predetermined interval, and the other end 180*b* of the pulling member 180 is connected to an upper end of the sliding shaft 154. When the load application part 130 and the sliding shaft 154 of the lifting part 150 are connected by the pulling member 180 via the direction shift guide wheel 81, the lifting part 150 is biased upward (Y-axial plus direction in the drawing) by the load of the load application part 130 via the sliding shaft 154.

The load transmission part 90 transmits the force of the load application part 130 to the rotation of the hand-pushing rotating part 170 about the shaft 160, and as shown in FIGS. 10 and 11, similarly to the load transmission part 90 of the training apparatus 100, has the rotation transmission part 91 which transmits the rotational movement of the hand-pushing rotating part 170 about the shaft 160, and a crank mechanism part 92 which converts the rotational movement transmitted by the rotation transmission part 91 into the up and down movement of the sliding shaft 154 connected to the other end 180*b* of the pulling member 180. When the hand-pushing rotating part 170 is axially rotated with respect to the lifting part 150, the sliding shaft 154 moves up and down via the rotation transmission part 91 and the crank mechanism part 92, and accordingly the weights 31 connected by the clamp (not shown) move up and down. As a result, the hand-pushing rotating part 170 is rotationally biased to the initial state by the force proportional to the load of the load application part 130. When the hand-pushing rotating part 170 is axially rotated with respect to the lifting part 150 from the initial state against the rotational biasing force, the sliding shaft 154 slides down with respect to the lifting part 150, and the weights 31 connected by the clamp are pulled up.

A training method using the training apparatus 200 is explained below with reference to FIGS. 6 to 9.

The suitable number of weights 31 are connected by the clamp (not shown) so that the suitable weight becomes the load of the load application part 130 according to the load suitable for the muscle strength and objects of a user. The user faces the rear (X-axial minus direction in the drawings) and sits on the seat 11, and adjusts and fixes the seat 11 to a suitable height so that the bottoms of user's feet touch the floor surface. The user adjusts and fixes the femoral region retaining part 25 to a suitable height so that the femoral region retaining part 25 contacts with the upper surfaces of the femoral regions of the user sat on the seat 11. The user trains with the user's back being suitably arched.

The user stands up, and while griping and pushing the other ends of the hand-pushing rotating parts 170 separated from the shafts 160, namely, the sides where the hand-pushing rotating parts 170 face, pushes down the hand-pushing rotating parts 170 as well as the lifting parts 150, and sits on the seat 11. At this time, the user raises the shoulders up, bends the knees, pulls in the forearms, and bends the wrist to the front side from the forearm.

As shown in FIG. 8, while maintaining the height of the hand-pushing rotating parts 170, the user twists both wrist inward against the rotationally biasing forces proportional to the loads of the load application part 130, and axially rotates the hand-pushing rotating parts 170 with respect to the lifting parts 150, and puts the hand gripping the hand-pushing rotating parts 170 inward with respect to the front direction.

When the user is in this "dodge movement" position, both the flexor muscles and the extensor muscles are "relaxed" so that the shoulder parts, arm parts and rear part are relaxed. Since the hand-pushing rotating parts 170 are biased also to the up direction by the loads of the load application part 130, the muscles of the rear part such as latissimus dorsi are suitably "stretched". Since the user grips the other ends of the hand-pushing rotating parts 170 separated from the shafts 160 and axially rotates the hand-pushing rotating parts 170, the user can axially rotate them with weaker force against the rotationally biasing force.

The user, as shown in FIG. 9, stretches both arms against the loads of the load application part 130 so that the suitably "stretched" muscles of the rear part are "reflected", "contracts" the muscles, and while making the "relaxing" and "stretching" movements, pulls the grip rotating parts 70 down with both the hands. When the user twists the wrist outward to axially rotate the hand-pushing rotating parts 170 to a direction opposite to the axial rotation with respect to the lifting parts 150, the loads at the first movement for pushing down the hand-pushing rotating parts 170 are reduced. When the user stretches both the arms to pull the hand-pushing rotating parts 170 down and "contracts" the muscles, the user further twist the wrist outward, and while making the "relaxing" and "stretching" movements. allows the suitable "contracting" timing to appear. As a result, the respective muscle groups obtain the "relaxing-stretching-contracting" timing, so that the movements can be made in good cooperation. When user stretches both the arms to pull the hand-pushing rotating parts 170 down, the lifting parts 150 are guided by the guide poles 140 so as to be moved vertically together with the hand-pushing rotating parts 170, and thus the user can smoothly stretch both the arms to push the hand-pushing rotating parts 170 down, thereby preventing the co-contraction of the muscles.

After pulling down the hand-pushing rotating parts 170 to approximately the height of waist part, the user twists the upper arms inward and bends both the elbows while gripping and pushing the hand-pushing rotating parts 170 with the hands according to the upward biasing forces due to the loads of the load application part 130, and returns to the seated state. As a result, one cycle of the training is completed. The suitable cycle number of the training is repeated.

The training apparatus 200 can suitably train the muscles of shoulder parts, arm parts and rear part according to the beginning movement load training. The beginning movement load training should be conducted after the entire movement images, such as the point at which a load is applied, the point and the angle and the rhythm at which the load is released, and the continuity of the muscle outputs, are obtained. Although it is difficult to take the suitable movements and forms due to the physical balance and partial hardening of a body at this stage, the series of training involving the ideal movements and forms are easily induced by the training apparatus 200.

The training apparatus of the present invention is not limited to the training apparatuses 100 and 200 according to the embodiments of the present invention. For example, the load application parts 30 and 130 may apply the loads by means of the weight of the weights 31 or may apply the loads by means of an electromagnetic power, a hydraulic pressure or an air pressure. When the electromagnetic power, the hydraulic pressure or the air pressure is used for the load application parts 30 and 130, the load application parts 30 and 130 are provided above the frames 20 and 120, respectively, and the direction shift guide wheels 81 may be omitted. With the training apparatuses 100 and 200, users sit on the seat part 10 and train themselves, but the users may train themselves in a standing state. When the users sit on the seat part 10 to train themselves, the entire height of the training apparatuses 100 and 200 becomes low, and thus the apparatuses can be installed in a training room or the like whose ceiling height is low and the training apparatuses 100 and 200 can be designed based on the seated heights of the users with less height variations.

In the above embodiments, the seat part 10, the load application parts 30 and 130, the guide poles 40 and 140, and the direction shift guide wheels 81 are mounted to the frames 20 and 120, but the apparatuses are installed in building, the seat part 10 and the guide poles 40 and 140 may be fixed to the floor surface, and the direction shift guide wheels 81 may be fixed to the ceiling. It is not always necessary to install all the components to one frame, and the present invention includes practically similar constitutions. Therefore, the frames 20 and 120 explained in the embodiments mean constructions such as components of buildings and floor surfaces which establish a immovable relationship.

DESCRIPTION OF REFERENCE NUMERALS

1, 100, 200: training apparatus
2, 10: seat part
3, 30, 130: load application part
4, 40, 140: guide pole
5, 150: lifting part
6, 60, 160: shaft
7: rotating part
8, 80, 180: pulling member
9, 90: load transmission part
20, 120: frame
31: weight
50: lifting/oscillating part (lifting part)
54: sliding shaft
70: grip rotating part (rotating part)
81: direction shift guide wheel
91: rotation transmission part
92: crank part
170: hand-pushing rotating part (rotating part)

The invention claimed is:

1. A training apparatus comprising:

a seat part;

a load application part including an adjustable load;

right and left guide poles extending vertically with a predetermined spacing therebetween so that the seat part is centered between the guide poles;

two lifting parts guided by the right and left guide poles to be movable up and down, respectively;

handles connected to respective rotatable shafts of the two lifting parts, respectively, wherein each handle includes a grip and is rotatable with the shaft;

pulling members each including two ends thereof, a first end being connected to the load application part and a second end being connected to the lifting parts; and load transmission mechanisms respectively comprised in the lifting parts and connected to the second end of the pulling member to mechanically couple the load of the load application part to rotations of the handles about the rotatable shafts.

2. The training apparatus according to claim 1, wherein the two lifting parts are guided by fitting the right and left guide poles into pivot ends of the two lifting parts to be movable up and down and rotatable horizontally, the shafts are fixed to distal ends of the two lifting parts, respectively, the handles connected to the shafts are rotatably provided below the lifting parts, and the second end of the pulling members is connected to a portion of the lifting part closer to the pivot end than the distal end.

3. The training apparatus according to claim 1, wherein the seat part, the load application part and the right and left guide poles are fixed to predetermined positions in one frame.

4. The training apparatus according to claim 3, wherein the load application part is composed of weights supported by the frame movable up and down and detachable from one another.

5. The training apparatus according to claim 1, wherein the load transmission part comprises:

a rotation transmission part which transmits a rotational movement about the shaft of the rotating part; and a crank mechanism part which converts the rotational movement transmitted by the rotation transmission part into an up and down movement of a sliding shaft connected to the other end of the pulling member.

6. The training apparatus according to claim 1, wherein the two lifting parts are guided by the right and left guide poles to be movable only up and down, respectively, and the rotating parts connected to the shafts are rotatably provided above the lifting parts.

7. The training apparatus according to claim 2, wherein the seat part, the load application part and the right and left guide poles are fixed to predetermined positions in one frame.

8. The training apparatus according to claim 1, wherein the seat part, the load application part and the right and left guide poles are fixed to predetermined positions in one frame.

9. The training apparatus according to claim 2, wherein the load transmission part comprises:

a rotation transmission part which transmits a rotational movement about the shaft of the rotating part; and a crank mechanism part which converts the rotational movement transmitted by the rotation transmission part into an up and down movement of a sliding shaft connected to the other end of the pulling member.

10. The training apparatus according to claim 1, wherein the load transmission part comprises:

a rotation transmission part which transmits a rotational movement about the shaft of the rotating part; and a crank mechanism part which converts the rotational movement transmitted by the rotation transmission part into an up and down movement of a sliding shaft connected to the other end of the pulling member.

11. The training apparatus according to claim 3, wherein the load transmission part comprises:

a rotation transmission part which transmits a rotational movement about the shaft of the rotating part; and a crank mechanism part which converts the rotational movement transmitted by the rotation transmission part into an up and down movement of a sliding shaft connected to the other end of the pulling member.

12. The training apparatus according to claim 4, wherein the load transmission part comprises:

a rotation transmission part which transmits a rotational movement about the shaft of the rotating part; and a crank mechanism part which converts the rotational movement transmitted by the rotation transmission part into an up and down movement of a sliding shaft connected to the other end of the pulling member.

* * * * *